United States Patent [19]

Nathanson et al.

[11] Patent Number: 5,061,930

[45] Date of Patent: Oct. 29, 1991

[54] MULTI-MODE MISSILE SEEKER SYSTEM

[75] Inventors: Harvey C. Nathanson, Pittsburgh, Pa.; Thomas E. Underwood, Edgewater, Md.

[73] Assignee: Westinghouse Electric Corp., Pittsburgh, Pa.

[21] Appl. No.: 536,924

[22] Filed: Jun. 12, 1990

[51] Int. Cl.[5] ..... F41G 7/22

[52] U.S. Cl. ..... 342/13; 342/62; 244/3.19

[58] Field of Search ..... 244/3.16, 3.19; 342/13, 342/14, 16, 62

[56] References Cited

U.S. PATENT DOCUMENTS

| | | | |
|---|---|---|---|
| 4,087,061 | 5/1978 | Burt . | |
| 4,190,837 | 2/1980 | Salvaudon et al. | 342/62 |
| 4,217,580 | 8/1980 | Lowenschuss | 342/13 |
| 4,735,379 | 5/1988 | Leveque et al. . | |
| 4,823,136 | 4/1989 | Nathanson et al. . | |

*Primary Examiner*—Mark Hellner

*Attorney, Agent, or Firm*—W. G. Sutcliff

[57] ABSTRACT

A broad band multimode seeker system for a missile includes a wide band phased array transmitter/receiver unit incorporating a wafer scale phased array device with a bandwidth of about 2 GHz to 35 GHz. A multimode intermediate frequency unit selectively generates radar and jamming waveforms and measures parameters of reflected radar and external emissions of RF energy. A guidance processor manages the front end assets for selective active or semiactive radar searching and tracking, and simultaneous searching for, tracking of, homing on, and applying a selection of electronic countermeasures to, multiple defensive radars. Confirmation of an assigned target is made through correlation of received RF signals with libraries of expected defensive system parameters and high resolution target profiles and preloaded target geographical coordinates.

15 Claims, 4 Drawing Sheets

MULTI-MODE MISSILE SEEKER SYSTEM

BACKGROUND OF THE INVENTION

1. Field of the Invention

This invention is directed to a seeker system for a missile which utilizes a wafer scale phased array seeker operated in a multi-function mode to simultaneously guide a missile to its target while providing anti-radiation seeking and jamming of antimissile defense radars and antimissile guidance heads.

2. Background Information

Current radar guided missiles utilize a mechanically driven antenna to locate and track a target. Several modes of operation are used. In a missile which operates in the active radar mode, the missile transmits on board generated radar pulses and receives radiation reflected from the target to its mechanically driven antenna. Semiactive radar missiles, which are generally used in the air to air environment, track on reflected radiation propagated by a ground or airborne launch vehicle. If the target is a radar system, some missiles can operate in an anti-radiation mode in which they track on the RF energy radiated by the target radar. Often a target will direct a jamming signal at a radar guided missile in an attempt to saturate its receiver or deceive its tracking system. In such an environment, many missiles can switch to a home on jam mode in which they guide on the jamming beam.

In currently anticipated realistic combat scenarios, an incoming missile could encounter awesome countermeasures, particularly surrounding a high value target such a large ship. Such vessels are equipped with sophisticated and powerful self defense fire control systems which use shipboard radars and antimissile missiles to track and destroy incoming missile threats Antimissile missiles can also be launched from other vessels supporting the high value target. Large numbers of incoming missiles are needed to overwhelm these defenses at great cost.

The mechanically driven radar antennas of the current missiles have a narrow look angle and slew too slowly to track widely separated targets, search radars and jamming sources. Phased array seekers have been developed which are electronically agile. By controlling the relative phase of RF energy between multiple apertures in the array, the resulting beam can be rapidly slewed over a wide area, for instance, a 120 degree cone about the center line of the array. Unfortunately, conventional phased array seeker systems are too large for a cost efficient missile. However, U.S. Pat. No. 4,823,136 discloses a wafer scale phased array seeker system in which a plurality of transmit/receive cells are incorporated into a three inch (7.62 cm) or four inch (10.16 cm) diameter wafer of semiconductor material. The seeker is indicated for use as a radar transmitter/-receiver with a narrow band antenna, and for use as an ECM transmitter/receiver with a broad band antenna.

U.S. Pat. No. 4,735,379 discloses a missile guidance system which utilizes an electronic scanning antenna. Several targets can be tracked simultaneously and the course of the missile controlled to maintain the plural targets within the range of action of the missile until a particular target is singled out using prelaunch stored target characteristics which are compared with the detected target returns. While this system has some capability of avoiding defensive jammers, it does not have the ability to jam defensive radar and antimissile weapons systems.

There remains a need for an affordable missile seeker system which can operate with a high $P_k$ (probability of kill) against a heavily defended target.

It is the object of the present invention to satisfy this need by providing a multi-mode missile seeker system which can track a target while providing self-defense ECM.

It is the further object of the invention to provide such a missile seeker system which can jam a threat which is widely separated angularly from the target being tracked.

It is another object of the invention to provide such a missile seeker system which can operate in either an active or semiactive radar mode or in an anti-radiation mode.

It is yet another object of the invention to provide such a missile seeker system which can jam an ECM source or home on a jamming target.

It is an additional object of the invention to provide a missile seeker system which can assess threats and automatically jam the greatest threats while continuing to track the target.

It is an overall object of the invention to achieve all of the above objectives with a missile seeker system which is of a size and weight such that it can be used in a practical sized missile.

SUMMARY OF THE INVENTION

These and other objects are realized by the invention which is directed to a multi-mode seeker system for a missile which includes a wide band phased array transmitter/receiver unit with an electronically agile aperture from which RF energy over a wide band of frequencies and in directions over a wide solid angle is transmitted and received. More particularly, the wide band phased array transmitter/receiver unit includes a wafer scale phased array device comprised of a plurality of semiconductor transmit and receive cells and a manifold for distributing RF energy waveforms to be transmitted to the wafer scale phased array device and for gathering RF energy received by the individual cells of the array.

The seeker system, according to the invention, further includes a multi-mode intermediate frequency unit which selectively generates radar and electronic countermeasure RF energy waveforms for transmission by the wide band phased array transmitter/receiver unit and which selectively detects and measures parameters of reflected radar transmitted by the system and external emissions of RF energy received by the wide band phased array transmitter/receiver unit. The system also includes a guidance processor which is responsive to the measured parameters of the received reflected radar and external emissions and controls selection of the radar and electronic countermeasure RF waveforms generated by the intermediate frequency unit and controls the direction in which the wide band phased array transmitter/receiver unit transmits and receives RF energy. This guidance processor controls the multi-mode intermediate frequency unit and the wide band phased array transmitter/receiver unit to selectively time multiplex transmission of radar and electronic countermeasure RF waveforms and reception of reflected radar and external emissions of RF energy for selective simultaneous tracking of targets with radar and searching for, tracking and applying electronic countermeasures to emitters of the external emissions of RF energy. Because of the wide bandwidth of the seeker system, the multi-mode intermediate unit has a narrow band section for detecting and measuring the parameters of reflected radar RF energy and a wide band section for detecting and measuring the parameters of the received external emissions of RF energy.

An emitter signal processing unit in the guidance processor responds to the parameters of external emissions of RF energy measured by the intermediate unit and identifies and tracks multiple external emissions of RF energy. A threat lethality unit identifies external emissions of RF energy tracked by the emitter signal processing unit which pose a lethal threat to the missile. An ECM technique means generates the parameters for the intermediate frequency unit to generate electronic countermeasure RF energy waveforms to jam the external emissions identified as a lethal threat, and generates the steering information for transmission of the electronic countermeasure RF energy waveforms by the wide band phased array transmitter/receiver unit. The system has the capability of simultaneously jamming multiple external emissions which may be widely separated in angular location and frequency. A wide assortment of ECM techniques can be employed. The guidance processor includes a home-on jam capability in which guidance signals are generated for steering the missile to home on an external emission of RF energy tracked by the emitter signal processing unit.

The system includes several means for singling out the assigned target where there are multiple, potential targets and external sources of RF emissions. For instance, the guidance processor includes a threat library storing parameters for expected external emissions of RF energy from the assigned target, and correlation means which correlate the stored parameters with the parameters of external emissions of RF energy tracked by the emitter signal processing means. The guidance processor also has a threat class library in which radar signatures of the assigned target are stored for comparison with the radar return received by the system. If there is no correlation, the guidance processor can search for and transfer tracking to another more likely target. Furthermore, the correlations between the radar data and the external emitter data can be fused to provide confirmation of target identification. The coordinates of the target can also be stored prior to launch, and used to verify a target by comparison with the calculated position of the target based upon RF energy received by the seeker system.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
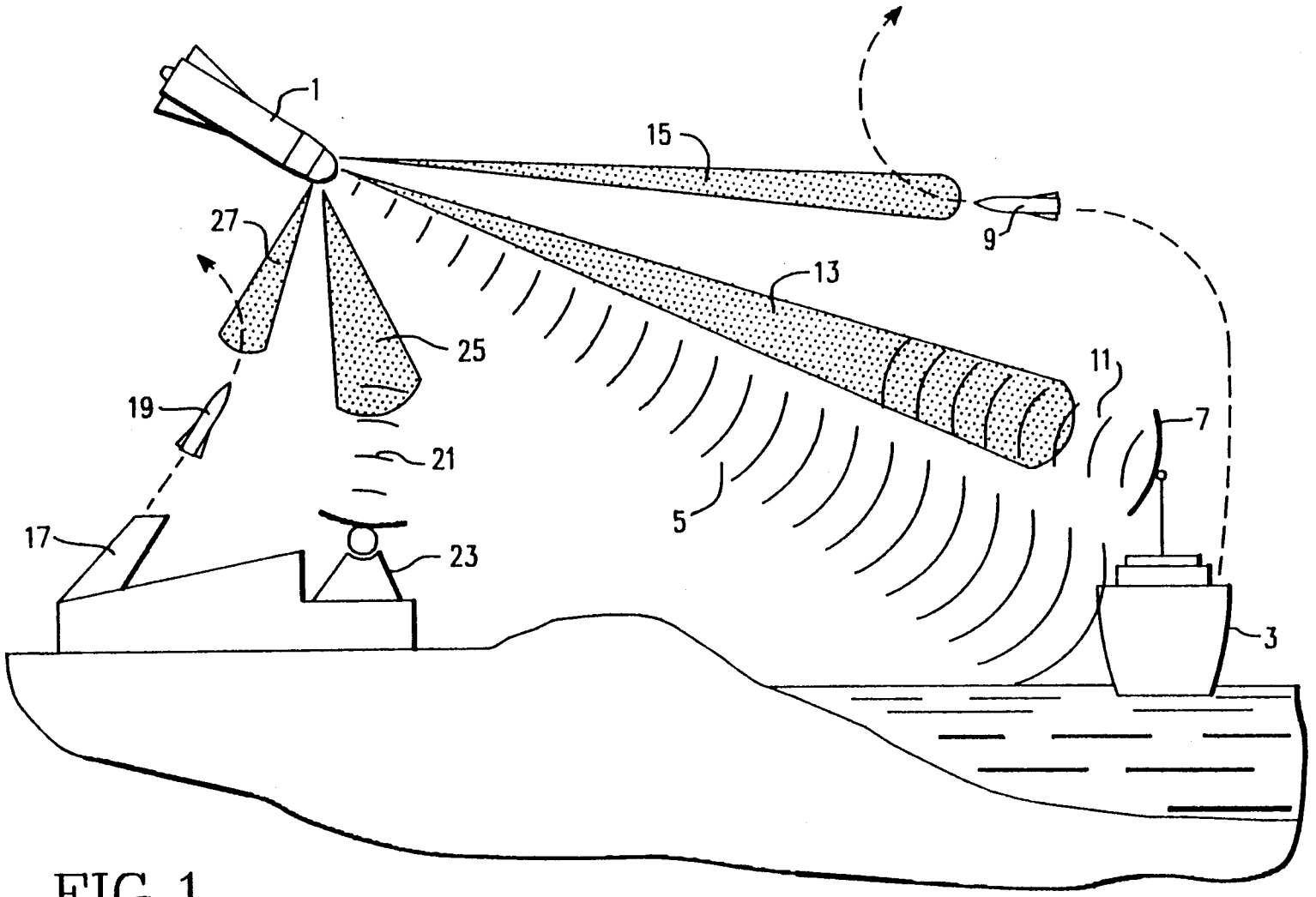
FIG. 1 is a sketch illustrating the operation of a missile incorporating the missile seeker system of the invention in a multi-threat environment.

FIG. 1 illustrates a missile 1 incorporating the missile seeker system of the invention in flight toward a target ship 3. The missile 1 is shown operating in the active radar mode in which the missile emits a radar beam 5 and tracks on RF energy from that beam reflected by the ship 3. The ship 3 is equipped with guidance radar 7 for a ship launched antimissile missile 9. The guidance radar 7 emits a radar beam 11 which is being jammed by a jamming beam 13 from the missile 1. The missile generates an additional jamming beam 15 which jams the missile 9.

At the same time, an ground based antimissile defense system 17 launches an antimissile missile 19 which is guided by a radar beam 21 emitted by a guidance radar system 23. The missile 1 generates jamming beams 25 and 27 for jamming the ground based radar 23 and ground launched antimissile missile 19 respectively.

The missile 1 can also operate in other modes. For instance, instead of transmitting an active radar beam 5, the missile 1 can track in an anti-radiation mode on the radar beam 11 emitted by the ship's radar 7. Also, if the ship tried to jam the missiles radar, the missile 1 could operate in a home on jam mode and fly down the jamming beam generated by the ship. Other modes of operation and features will be described in the following discussion.

Figure 2:
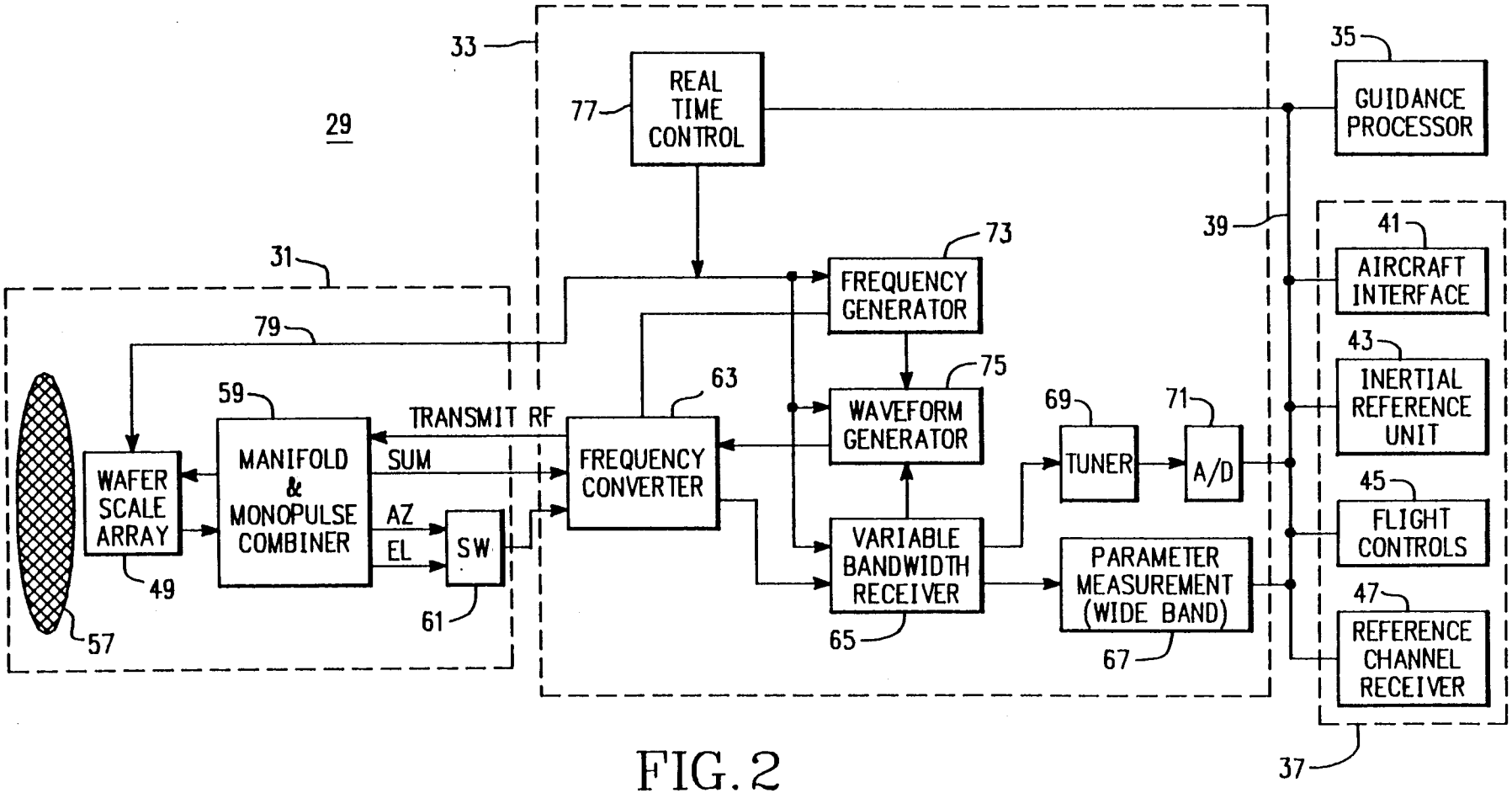
FIG. 2 is a schematic diagram in block form of the hardware of the missile seeker system of the invention.
Figure 3:
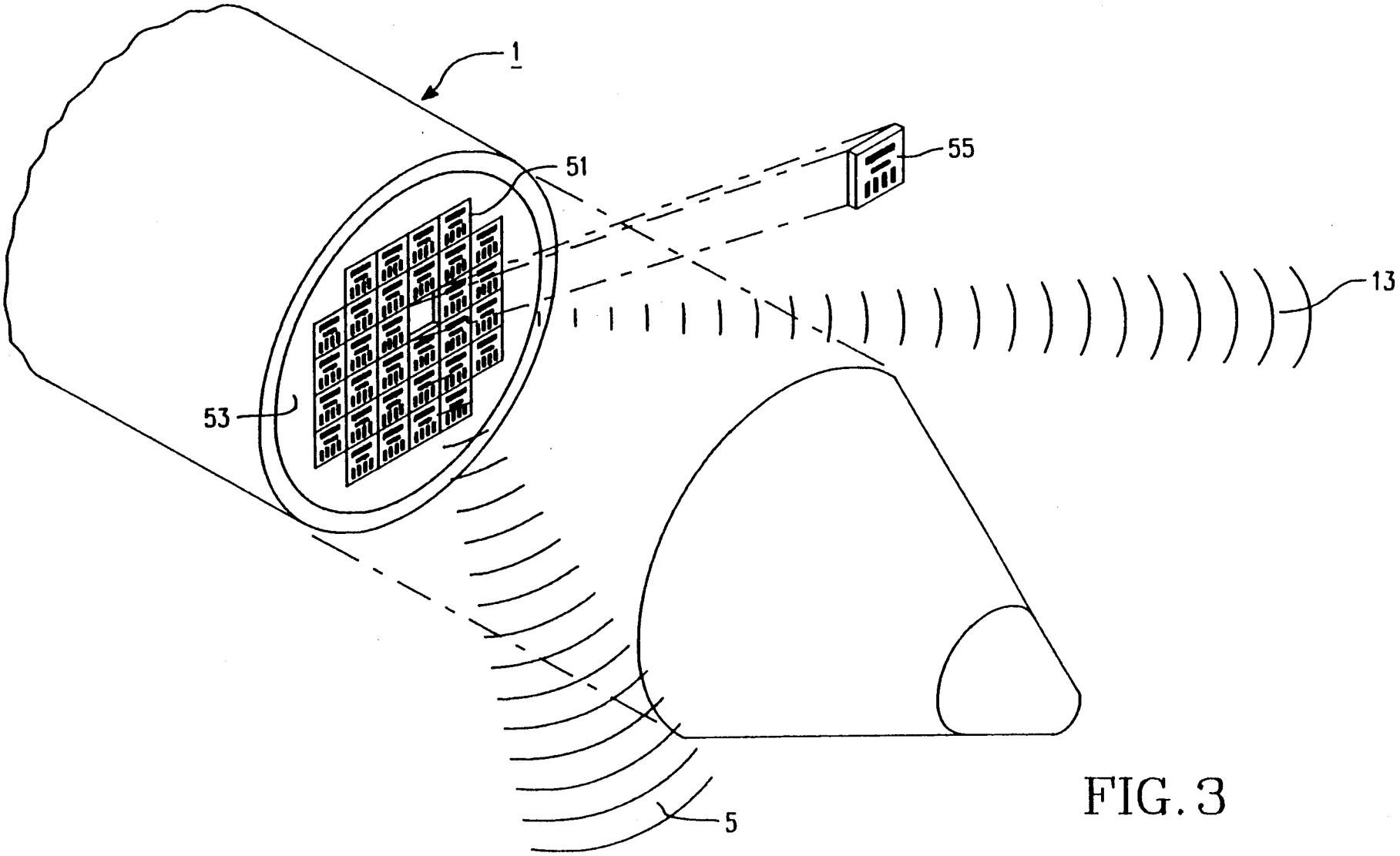
FIG. 3 is a schematic diagram illustrating the structure of a wafer scale sensor which forms part of the missile seeker system disclosed in FIG. 2

FIG. 2 is a block diagram of the missile seeker system 29 of the invention which is incorporated into the missile 1. Major subsystems of the seeker system 1 are a wide band phased array antenna unit 31, an intermediate frequency (IF) unit 33 which provides receiver and transmit waveform generation functions, and a missile guidance processor 35. These basic components of the missile seeker system 29 communicate with other missile systems through external interfaces 37 over a missile data bus 39. An aircraft interface bus 41 communicates with the host aircraft. This interface can be used to provide the seeker system 29 with target location, target image characteristics, expected defensive systems and other information. The inertial reference unit interface 43 provides missile movement information which the guidance processor uses for navigation and determining missile orientation. This information is used among other things for orienting the emitted beams, determining the direction of received signals and for generating flight control signals which are passed to the missile's flight controls through a flight control interface 45. An additional interface 47 to a reference channel receiver is required if the missile is to operate in the semiactive radar mode. Also, air to air variants which require communication with the launch aircraft would do so through the reference channel receiver.

The wide band phased array unit 31 is configured as a three channel monopulse front end using a wafer scale integrated device 49 to provide RF power amplifiers for transmit, low noise amplification for receive, an integrated phase/amplitude control for beam steering and illumination taper for pattern side lobe control. The wafer scale integrated device 49 is a broad band multi-element device. The exemplary wafer scale device is a 32 element $\frac{1}{4}$ to $\frac{1}{2}$ watt 2 to 35 GHz array. The 32 element array 51 is shown on a three inch wafer 53 in FIG. 2. Each transmit/receive cell 55 of the array 51 contains redundant components and a vertical architecture as described in U.S. Pat. No. 4,823,136 issued on Apr. 18, 1989. With 32 one half watt cells 55, a 16 watt beam 5 should be possible for the radar mode. For jamming, the 32 one half watt cells 55 should result in an effective radiated power (ERP) jam signal 13 of about $P_{cell}N2$ or approximately 512 watts, more than enough to jam the return from the small cross section end view of the approaching missile. An array of any number of cells can be produced by trimming individual wafers containing sets of cells so that they may be arranged side-by-side in a common plane. An array with dozens to hundreds of cells can be fabricated in this manner.

Wideband radiating elements associated with each of the transmit and receive cells 55 create a wide band electronically agile aperture 57 for transmitting and receiving RF signals. A manifold and monopulse combiner 59 distributes RF energy to be transmitted and collects received RF energy from the individual cells of the wafer scale array 49. It also generates the sum, and azimuth and elevation difference signals for monopulse operation. The monopulse difference channels are multiplexed by a switch 61 to allow full monopulse measurement with a two channel receiver. Alternate configurations based on so called "single channel monopulse" wherein the three receive beams are sampled sequentially to allow further reduction in the complexity of receiver hardware are similar in nature and may be preferred due to their lower cost and weight. Multiple channel monopulse is used in the exemplary system because of its superior capability to reject the effects of jamming.

The intermediate frequency unit 33 includes a frequency converter 63 which mixes the RF from the wide band phased array unit 31 down to a first intermediate frequency (IF) which is nominally in the 6–10 GHz range. A variable bandwidth IF receiver 65 follows the down conversion to allow a choice of wide band electronic support measures (ESM) signal acquisition to support anti-radiation missile (ARM) guidance and electronic countermeasure (ECM), or narrow band operation for semiactive or active radar homing guidance modes. For wide band operation, a parameter measurement unit 67 utilizes logarithmic amplifiers and an IF analog frequency discriminator for efficient parameter measurement. A wide band phase detector is also included in the parameter measure unit 67 to support wide band monopulse angle measurement for ARM guidance, and to control the directional ECM operation inherent in the seeker design. For the narrow band operation for either active or semiactive radar operation, a tuner 69 performs a further down conversion to base band using a linear receiver. A wide dynamic range analog to digital (A/D) converter 71 provides sample data (in phase and quadrature channels) for a Fast Fourier Transform (FFT) process implemented in the guidance processor 35.

A common frequency generator 73 provides local oscillators used for down conversion of received signals and up conversion of either terminal homing radar or active jamming waveforms. It also generates the basic transmit waveform for homing radar and supports normal doppler radar operation as well as high resolution waveforms such as serial synthetic spectrum for target identification.

A waveform generator 75 imposes modulation from a real time controller (RTC) 77 to generate the radar and ECM waveforms. For the countermeasure modes of operation, the waveform generator 75 includes a digital RF memory (DRFM) to allow coherent transponder operation against doppler fire control systems. Noises can be generated either by preloading the DRFM with a noise waveform or by frequency modulating the output of the DRFM. This allows the seeker to have a wide range of countermeasure technique diversity for essentially no additional cost.

A common digital real time controller 77 generates the pulse repetition frequencies (PRFs) and envelope waveforms for radar operation, and false target waveforms for ECM techniques. The controller 77 also provides timing for transmitter/receiver synchronization. The timing controls and AM/FM modulation waveforms for ECM and radar operation are distributed to the various front end assets via a high speed seeker control bus 79 in near real time.

The guidance processor 35 contains a programmable signal processor and a data processor which implement active and semiactive radar signal processing functions which require high throughput capacity. The data processor supports target tracking algorithms, emitter identification and homing processing for ARM guidance modes and technique management for active jamming functions. The missile data bus 39 provides the interface for receiver data from the seeker front end to the guidance processor 35, and for seeker control data to the real time controller 77 which provides the tuning and timing commands to the various front end assets. The missile data bus 39 also provides a common interface for data transfer to and from other external units through launch aircraft interface 41, the inertial reference unit interface 43, the flight control interface 45 and the reference channel receiver interface 47.

Figure 4:
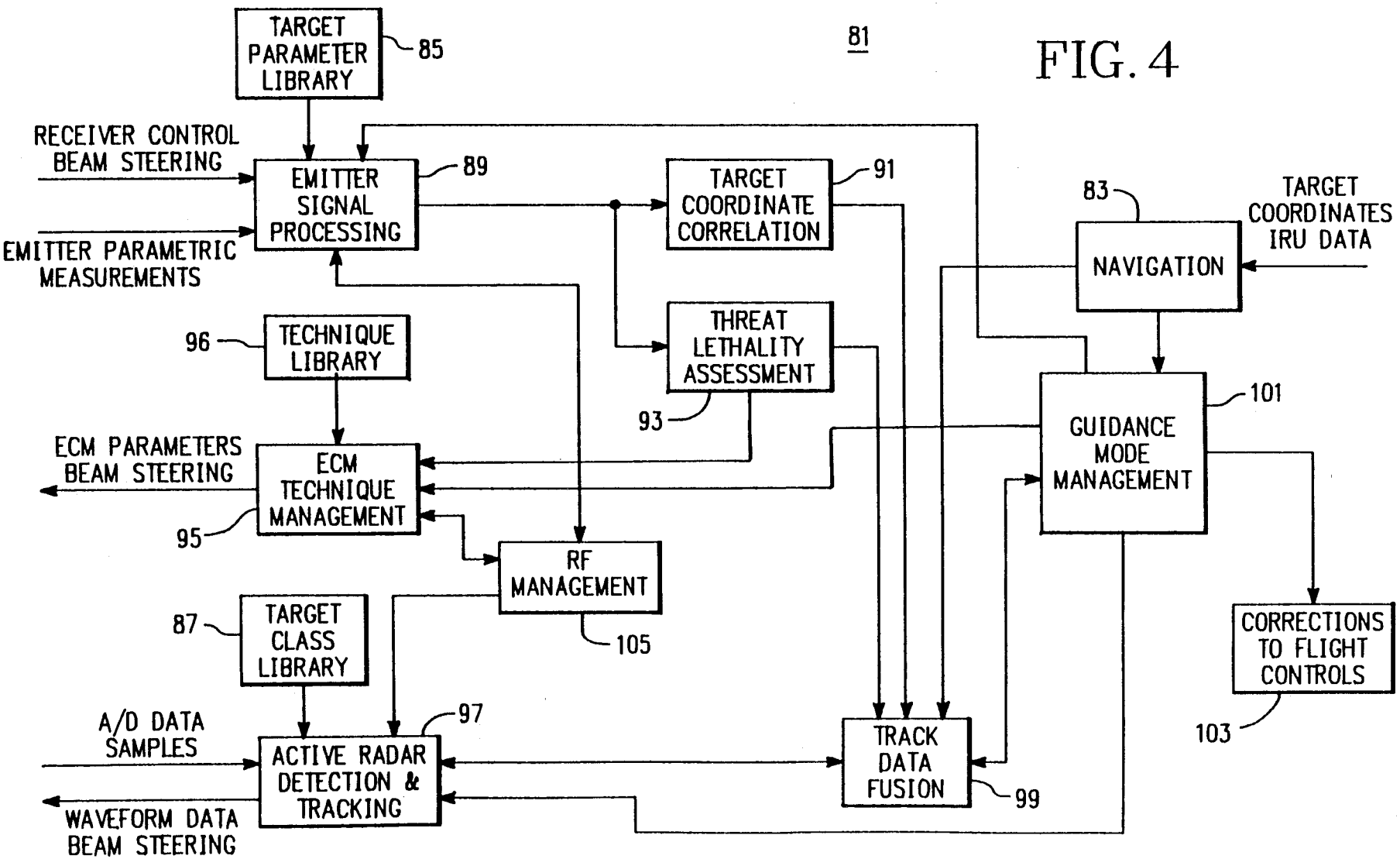
FIG. 4 is a flow chart of the software which forms part of the missile seeker system shown in FIG. 2.

A flow diagram for the software 81 of the guidance processor 35 is shown in FIG. 4. This software implements all of the signal processing and control functions necessary for the missile to seek-while-jamming. In the preferred method of operation, the missile navigation module 83 is loaded with the coordinates of the target prior to launch. The target coordinate and inertial reference unit data are input through the aircraft and inertial reference unit interfaces 42 and 43, respectively. In addition, the parameters of known emitters aboard the target are downloaded through the aircraft interface 42 into a target parameter library 85. Prelaunch, the missile itself may be used as a sensor to determine these parameters if the sensitivity of the missile seeker exceeds that of sensors on the launch aircraft. If the target class is identified, high range resolution radar signature data can be downloaded from the aircraft into a target class library 87. For instance, if the target is known to be an aircraft carrier, the radar signature of the aircraft carrier can be loaded into the target class library 87. Target class identification can be used as a secondary source of identification to the emitter signature to enhance the seekers capability to positively identify and maintain track on its target in the presence of potential self-protection measures taken by the target.

The emissions from the target are analyzed by an emitter signal processing function 89 which receives the emitter parametric measurements from the parameter measurement unit 67. The processing includes receiver management to tune the wide band phased array unit 31 in frequency to search for all emitters known to be on the target and then to perform the necessary pulse sorting and deinterleaving functions necessary to detect and identify the target from the potentially large number of signals in the environment. As the missile 1 flies toward the target, the emitter signal processing functions 89 not only search for target emissions for homing purposes, but also search for the potential threats anticipated to be used against it and stored in the target parameter library 85. This search includes not only the angular sector containing the target, but also as much surrounding space as can be accommodated by the field of regard of the phased array unit 31. A spoiled beam is used for the threat signal search to allow it to be accomplished more rapidly. The full aperture 57 of the phased array unit 31 is used for measurements on the target to enhance the accuracy of tracking measurements. This search permits the seeker electronic signal processing function 89 to detect any fire control system which may used to try to shoot the missile down. In an inner air battle situation, other surface combatants or aircraft, for example, may be assigned responsibilities for defending critical assets such as aircraft carriers. Maintaining a search for such threats allows the seeker the option of implementing self-protection countermeasures to enhance its probability of surviving to destroy the target. Measurements from different intercepted emissions are compared by a target coordinate correlation module 91 with the expected target coordinates to assure that the emissions from different sources are not allowed to corrupt the target state estimate in the guidance tracking filter of the emitter signal processing function 89. Co-located emitters from the same angle are associated and used to check for consistency with the target platform identity defined at launch. By using targeting emission sets to confirm identify, the seeker gains a measure of immunity from decoy counter measures which may capture other seeker guidance modes.

A threat lethality assessment module 93 monitors the target emissions processed by the emitter signal processing function 89 to determine the degree of threat. If the lethality assessment module 93 determines that the missile has become engaged by a fire control system, it initiates self-defense countermeasure operation by an ECM technique management module 95. The ECM technique management module 95 selects from an ECM technique library 96 and implements an ECM technique optimized for the specific threat system. Since the seeker has a DRFM (in the waveform generator 75), a full range of ECM techniques can be supported including: noise, repeater and coherent range and velocity deception. The ECM technique management module 95 generates the appropriate ECM parameters and provides beam steering information for the seeker. Through the use of the electronically steered beam, high effective radiated power (ERP) jamming can be directed at emitters either on the target or elsewhere as needed. The jamming is timed integrally with emitter measurements on a look-through budget designed to optimize the balance between the functions supported at any given time by the time shared front end resources. The capability of being able to support not only self protection jamming against the target, but also to be able to use it against emitters not associated with the target is made possible by use of the wafer scale front end technology which provides a compact light weight, electronically agile aperture.

When the navigation function 83 concludes that the missile is within a programmed terminal approach range, the seeker has an option to initiate an active radar homing guidance mode. The active radar detection and tracking module 97 generates waveform data and beam steering information to the intermediate frequency unit 33. A Fast Fourier Transform is applied to target data received from the A/D converter 71 to extract the target from clutter. The active radar detection and tracking function 97 steers the active radar beam to track the target, controls the track filters and monitors errors in tracking to schedule when to generate the next radar measurement. The update rate is minimized consistent with good tracking data to reduce the schedule burden on the front end assets as in the case with the ECM processing.

The active radar detection and tracking function 97 also compares the returned radar image with the high resolution image stored in the target library 87 to provide additional confirmation of the target's identify. If target emissions provide sufficient guidance data for the emitter signal processing function 89 the active radar mode may not be critical. It can still in this instance provide an independent confirmation of the target's identify through the comparison with the stored high resolution map of the target. If the target ceases emission, active radar homing can be initiated to fill the gap. If the target's threat warning sensors detect the seeker emissions and initiate self protection countermeasures, then the emitter signal processing function 89 can transition to a home on jam mode or the broad band capability of the seeker can be employed to identify a clean frequency band in which to operate. The bandwidth of the seeker is sufficient to make the self-protection jammer task for the target extremely difficult. An option also exists to place the seeker frequency for active radar very close to a high power emitter onboard the target. This forces the target to deny itself either self protection jamming or fire control radar. For most practical ship self-protection systems, placing the seeker a few megahertz (5–10 MHz) from an onboard radar, will permit the missile seeker 29 an opportunity to operate with impunity since the targets onboard threat warning receiver will have to filter out its own fire control radar emissions and will probably filter out the missile seeker in the process.

An onboard track data fusion function 99 in the seeker guidance processor 35, allows the ARM mode target data from the emitter signal processing function 89 to be compared with comparable data from the active radar seeker 97 and the preflight target coordinates. This serves to confirm target identity through independent measurements. It also makes possible an inexpensive but robust capability to overcome the effects of such countermeasures as emission control, chaff, active decoys, radar cross-section (RCS) reduction and jamming. All of these techniques attack only one of the seekers guidance techniques, and either have no effect on or actually enhance the others.

The guidance mode management function 101 accesses the fused track files generated by the track data fusion function 99 and the current navigation function 83 and optimizes the selection of a guidance mode which include the active mode, semiactive mode, homing and self-protection ECM. It also determines which target to track and can switch targets if data received from the track data fusion function 99 indicate that another target better matches the assigned target. The guidance mode management function 101 also utilizes data from the navigation function 83 to generate missile control signals 103 which are passed to the flight controls through the flight control interface 45. In applications where a semiactive radar mode is feasible (e.g., air-to-air), the guidance mode management function 101 includes that data in its control mode optimization operation. Semiactive data is sensed through the same hardware and signal processing functions as active radar but with a reference signal being provided by a reference receiver through the reference channel receiver interface 47.

An RF management function 105 develops usage schedules for the functions which the guidance mode management function 101 selects. Since in general, the functions are in conflict for hardware resources, arbitration must be performed. Target tracking update measurements do not generally require high asset duty cycles. Update rates from one to perhaps ten Hertz suffice for most tracking functions independent of whether active, semiactive or ARM homing guidance modes are being used. Data collection requirements for the necessary measurements are generally low (a few milliseconds) compared to the update rate. This allows a reasonable amount of schedule for emitter search and self-protection jamming to be interleafed. When jamming is needed, it tends to be a relatively high user of asset duty cycle (perhaps 80–90 percent to maintain effectiveness), hence, the task for the RF management function 105 is to schedule asset utilization in such a way as to optimize overall missile performance. While this is a significant extension in the sophistication of missile seekers compared to systems in current inventory, it is not difficult to achieve. Given the extraordinary resource of the high gain seeker front end which has the bandwidth and the sensitivity to support all of these guidance modes, scheduling is relatively straight forward to implement. Real time micromanagement of the front end resources, including such functions as beam steering, receiver dwell timing, receiver tuning, and coherent integration period timing are performed by the real time control processor 77 under the control of the RF management function 105 and the guidance processor 35.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A multi-mode seeker system for a missile comprising:

a wide band phased array transmitter/receiver unit having an electronically agile aperture through which RF energy over a wide band of frequencies and in directions over a wide angle in both azimuth and elevation is transmitted and received;

a multi-mode intermediate frequency unit selectively generating radar and electronic countermeasure RF energy waveforms for transmission by said wide band phased array transmitter/receiver unit, and selectively detecting and measuring parameters of reflected radar and external emissions of RF energy received by said wide band phased array transmitter/receiver unit; and a guidance processor responsive to the measured parameters controlling selection of said radar and electronic countermeasure RF energy waveforms generated by said intermediate frequency unit and for controlling the direction in which the wide band phased array transmitter/receiver unit transmits and receives RF energy.

2. The system of claim 1 wherein said wide band phased array transmitter receiver unit includes a wafer scale phased array device comprising a plurality of semiconductor transmit and receive cells and a manifold for distributing RF energy waveforms to be transmitted to and for gathering RF energy received by, said semiconductor transmit and receive cells.

3. The system of claim 2 wherein said wide band phased array transmitter/receiver unit transmits and receives RF energy over a range of frequencies from about 2 GHz to about 35 GHz.

4. The system of claim 2 wherein said guidance processor includes means controlling said multi-mode intermediate frequency unit and said wide band phased array transmitter/receiver unit to selectively time multiplex transmission of radar and electronic countermeasure RF energy waveforms and reception of reflected radar and external emissions of RF energy for selective simultaneous tracking of targets with radar, and searching for, tracking and applying electronic countermeasures to emitters of said external emissions of RF energy.

5. The system of claim 4 wherein said multi-mode intermediate frequency unit includes first narrowband means detecting and measuring parameters of said reflected radar RF energy and second wide band means detecting and measuring parameters of received external emissions of RF energy.

6. The system of claim 5 wherein said guidance processor includes emitter signal processing means responsive to the parameters of external emissions of RF energy measured by said second wide band means for identifying and tracking multiple external emissions of RF energy.

7. The system of claim 6 wherein said guidance processor includes threat leathality means identifying external emissions of RF energy tracked by said emitter signal processing means which pose a lethal threat, and ECM technique means generating parameters for said intermediate frequency unit to generate said electronic countermeasure RF energy waveform to jam the external emission identified as a lethal threat and generating steering information for transmission of said electronic countermeasure RF energy waveform by said wide band phased array transmitter/receiver unit.

8. The system of claim 7 wherein said ECM technique means includes means for generating parameters for said intermediate frequency unit to generate time multiplexed electronic countermeasure RF energy waveforms and for simultaneously jamming multiple external emissions of RF energy identified as lethal threats by said lethal threat means and generating steering information for transmission of said time multiplexed electronic countermeasure RF energy waveforms by said wide band phased array transmitter/-receiver unit.

9. The system of claim 6 wherein said guidance processor includes means for selectively generating guidance signals for steering said missile to selectively home on an external emission of RF energy tracked by said emitter signal processing means.

10. The system of claim 6 wherein said guidance processor includes a threat library storing parameters for expected external emissions of RF energy from an assigned target, and correlation means correlating parameters of the external emissions of RF energy tracked by said emitter signal processing means with the stored parameters of said expected external emissions of RF energy to identify the assigned target.

11. The system of claim 10 wherein said guidance processor includes active radar tracking means responsive to parameters of radar RF energy measured by said first narrowband means to actively radar track a target illuminated by radar waveforms transmitted by said wide band phased array transmitter/receiver unit, a target class library storing expected parameters of radar RF energy expected to be reflected by the assigned target and means correlating the measured parameters of radar RF energy received with the expected parameters of radar RF energy to identify the assigned target.

12. The system of claim 11 including means fusing identification of the assigned target by said correlation means and identification of the assigned target using said threat class library to confirm the assigned target.

13. The system of claim 6 wherein said guidance processor includes means storing the expected geographic coordinates of an assigned target, and means tracking the geographic position of the missile during flight, determining therefrom and the parameters of received RF energy the geographic location of targets being tracked, and correlating the determined geographic location of a target with the expected geographic location to confirm tracking of the assigned target.

14. The system claim 4 wherein said guidance processor includes means for storing parameters for identifying an assigned target and means correlating said stored parameters with the measured parameters of received RF energy to identify received RF energy associated with the assigned target.

15. The system of claim 14 wherein said guidance processor includes means to generate signals guiding said missile to the assigned target by tracking the received RF energy identified as associated with the assigned target, and to transfer guidance to another target when the measured parameters of received RF energy associated with said another target better correlate with the said stored parameters for the assigned target.

* * * * *